United States Patent [19]

Ibrahim et al.

[11] 4,329,852

[45] May 18, 1982

[54] OPEN TOP MULTIBAND REFRIGERATED DISPLAY CASE

[75] Inventors: Fayez F. Ibrahim, Niles; Arthur Perez, Buchanan, both of Mich.

[73] Assignee: Tyler Refrigeration Corporation, Niles, Mich.

[21] Appl. No.: 8,111

[22] Filed: Jan. 31, 1979

[51] Int. Cl.[3] ..... A47F 3/04

[52] U.S. Cl. ..... 62/256

[58] Field of Search ..... 62/254, 156

[56] References Cited

U.S. PATENT DOCUMENTS

| | | | |
|---|---|---|---|
| 2,306,969 | 12/1942 | MacMaster | 62/256 X |
| 2,568,268 | 9/1951 | Booth | 62/255 |
| 2,923,135 | 2/1960 | Preotle | 62/255 X |
| 3,168,818 | 2/1965 | Weber | 62/256 |
| 3,226,945 | 1/1966 | Spencer | 62/256 |
| 3,291,027 | 12/1966 | Beckwith | 62/256 X |
| 3,499,295 | 3/1970 | Brennan | 62/254 |
| 3,543,532 | 12/1970 | Gatton et al. | 62/256 |
| 3,827,254 | 8/1974 | MacMaster et al. | 62/256 |
| 3,996,763 | 12/1976 | Karashima | 62/256 |
| 4,106,305 | 8/1978 | Ibrahim | 62/256 X |
| 4,144,720 | 3/1979 | Subera et al. | 62/282 X |

FOREIGN PATENT DOCUMENTS

| | | | |
|---|---|---|---|
| 52-28053 | 8/1977 | Japan | 62/256 |

*Primary Examiner*—Daniel M. Yasich

*Attorney, Agent, or Firm*—LeBlanc, Nolan, Shur & Nies

[57] ABSTRACT

An open top refrigerated display case having an upper display portion for displaying refrigerated products and a lower storage portion for storing refrigerated products. A cooling mechanism cools both the display portion and storage portion. The cooling mechanism establishes a refrigerated air band which encircles the display portion. This refrigerated air band is established by circulating air through an air conduit which surrounds the display portion and is positioned above the storage portion of the display case. Mounted within the air conduit is a fan and a set of evaporation coils. Air is expelled from one end of the conduit at an outlet opening located near the top of the display case and such air is propelled across the opening in the display case towards the opposite end of the case where it is received by an inlet opening of the air conduit. In this manner, an air curtain is formed across the top of the display case. During a refrigeration cycle the air passing along this air band is cooled thereby cooling the display portion of the display case. In addition, air from the air conduit is diverted after it has passed through the evaporation coils into the lower storage portion where it is directed around the storage portion and flows into the air conduit where it is recirculated by the fan within such conduit.

38 Claims, 9 Drawing Figures

OPEN TOP MULTIBAND REFRIGERATED DISPLAY CASE

BACKGROUND OF THE INVENTION

The present invention relates to an open top refrigerated display case having a storage portion. As the terms are used within this application, all references to refrigeration apparatus or operations are intended to include cooling both at temperatures in excess of 32° F., for example, in fresh meats display cases and temperatures below 32° F., for example, in frozen foods display cases.

In order to enable an open top refrigerated display case to be readily restocked as the need arises, a lower storage portion can be provided within such cases. Such an arrangement can be easily carried out since at least part of the bottom portion of such cases are usually unused because the depth of the interior of the display portion of the case must be limited in order to enable the consumers to readily obtain access to the products within the display portion. Thus, open top refrigerated display cases, which also include well type display cases, are provided with an upper display portion in which the refrigerated products are displayed for access by the consumer and a lower storage portion in which refrigerated products can be stored for readily restocking the display portion of the case.

Since refrigerated products are held in both the display portion and storage portion of the display case, both sections of the case must be appropriately cooled. A variety of different arrangements of cooling systems have been employed for such purposes within prior art systems. Possibly the most common of such systems have been those which merely circulate cool air throughout the entire case with air passing between the display portion and the storage portion of the case through a grating or similar structure, separating the display and storage portions. Typical of such arrangements are those illustrated in U.S. Pat. Nos. 2,306,969 to MacMasters, 2,348,988 to Lowell and 2,425,473 to Hoffman. The refrigerated display cases illustrated in all three of these patents are of the type where the refrigerated products can be viewed through windows in the front of the case while access to the displayed products are obtained through doors in the rear of the case; such display cases are typically utilized in delicatessan counters where an employee is present to assist the consumer.

Open top refrigerated display cases, i.e. where access to food contained within the display portion is obtained through an opening in the top of the case, which have lower storage sections are illustrated in U.S. Pat. Nos. 2,290,647 to Lowell, 2,631,438 to Weber and 3,226,945 to Spencer. In the patent to Lowell, a system is illustrated where the air circulating fan and refrigeration unit are provided within a chamber at the bottom of the case on one side of a lower storage section. Air is circulated by the fan through the refrigeration coils, which are both located within the chamber in the bottom of the case and such refrigerated air partially passes into the storage section and the remainder travels a path upwardly into the display section of the case. In the patents to Weber and Spencer, a continuous band of refrigerated air is established with an air curtain being provided across the opening in the display portion of the display case in order to protect the products within the case. Another patent which illustrates a refrigerated case with a storage section but instead of a top opening having a front opening therein is U.S. Pat. No. 2,476,491 to Henderson.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves the use of electric resistance heaters that are arranged adjacent to the refrigeration coils of the refrigeration mechanism. During a defrost cycle, these heaters supply in an effort to eliminate the frost buildup on the coils; however, the heaters also add warmer air to the air conduit for circulation within the case. During such a defrost cycle, the fans for circulating air through the primary conduit, i.e. the conduit in which the coils are located, can be turned off as disclosed in U.S. Pat. No. 3,756,038 to MacMaster et al. The particular technique is relatively simple both in its construction and operation. These electrical heaters are high wattage heaters that utilize significant electricity during operation. Furthermore, the warm air circulated in the case can raise the temperature of the case too high. Thus, attempts have been made to find alternatives to such a system.

A second type of system circulates compressed gaseous refrigerant through the refrigeration coils during the defrost cycle. During the defrost cycle, a valve control mechanism shuts off the supply of refrigerant to the refrigeration coils and alternatively feeds compressed gaseous refrigerant through the coils. This gas serves to reduce any frost buildup that has occurred on the refrigeration coils but simultaneously provides heat within the air conduit which can be circulated through the display case, which again is disadvantageous. Due to the requirement that the system be able to selectively switch between the supply of the gas for defrosting and refrigerant to the refrigeration coils, a valving structure must be provided. Such a mechanism increases the cost of construction of the system. In addition, the provision of such a system increases the number of parts capable of breaking down thereby necessitating costly repairs.

The third type of system employed for defrosting display cases relies upon ambient air. It is this general category with which the invention of the present application is concerned. One type of system that employs ambient air during the defrost cycle is exemplified by those embodiments illustrated in U.S. Pat. Nos. 3,403,525, 3,850,003 and 3,937,033, all to Beckwith et al. These systems use fans separate and distinct from the main air circulating fans. These extra fans are only turned on during the defrost cycle for pulling ambient air from outside of the display case directly into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith et al. U.S. Pat. No. 3,850,003 indicates that the concepts described in U.S. Pat. Nos.

3,082,612 and 3,403,525 did not prove to be practical and hence were not commercially feasible.

Finally, a third type of ambient air defrosting system is shown in U.S. Pat. No. 4,144,720 to Subera et al., which is assigned to the same assignee as the present application. In the foregoing patent application, an open front refrigerated display case having primary and secondary air conduits is disclosed. In this system, the direction of airflow within one of the conduits is reversed, for example by the use of reversible fans for ambient air defrost. Other patents illustrating ambient air defrost systems are U.S. Pat. No. 4,026,121 to Aokage, which illustrates an open front display case, and U.S. Pat. No. 4,120,174 to Johnston, which illustrates an open top display case.

SUMMARY OF THE INVENTION

An object of the present invention is to provide an improved refrigerated display case having both a display portion and a storage portion.

Another object of the present invention is to provide a refrigerated display case having a display portion and a storage portion which case can be more efficiently operated as compared to previously known display cases having display and storage portions.

A further object of the present invention is to provide a refrigerated display case having display and storage portions where an ambient air defrost system is employed within such case.

Still another object of the present invention is to provide an open top refrigerated display having an upper display portion and a lower storage portion in which cool air is effectively and efficiently circulated through the case for efficiently cooling both the display and storage portions of such case.

A still further object of the present invention is to provide an open top refrigerated display case having an upper display portion and a lower storage portion, which case employs an ambient air defrost system for efficiently and effectively defrosting the case on a periodic basis during its operation.

A still additional object of the present invention is to provide a multiband refrigerated display case having an upper display portion, in which a first air conduit which carries refrigerated air encircles the display portion of the case for cooling such portion and also provides refrigerated air to the lower storage portion of the case and a secondary air conduit encircles both the display portion and storage portion with such secondary conduit carrying air which is cooler than ambient air but unrefrigerated.

A still further object of the present invention is to provide a multiband open top refrigerated display case having a display portion and a storage portion.

Another object of the present invention is to provide a multiband open top refrigerated display case having a display portion and a storage portion which employs an ambient air defrost system.

The above objectives of the present invention are achieved by the display cases constructed in accordance with the present invention. Such display cases are open top cases having an upper display portion in which refrigerated food products can be held for display to and access by the consumer and a lower storage portion in which refrigerated products for restocking the display portion can be held. The display case has a cooling system which serves to cool both the display portion and the storage portion of the case. The cooling system includes a mechanism for establishing a refrigerated air band which encircles the display portion. This mechanism for establishing the refrigerated air band includes a first air conduit which encircles only the display portion and is positioned above the storage portion of the case. Within this air conduit is at least one fan and a set of refrigeration evaporation coils. In actuality, for an eight-foot long case there is typically provided two fans and for a twelve-foot long case, three fans would be provided; the number of fans, however, can be varied. The air conduit is U-shaped and ends at the upper portion of the display case at opposite sides of the opening in the top of the display case. At one end of the conduit is an air outlet and at the opposite end is an air inlet. The air outlet and air inlet are in alignment so that air expelled from the air outlet will be directed across the opening in the top of the display case and received by the air inlet in the opposite end of the air conduit. Thus, by circulating air through the conduit and refrigerating such air as it is circulated, a continuous band of refrigerated air can be established encircling the display portion with an air curtain being mainteined across the opening in the top of the display case. After this refrigerated air has passed through the evaporator coils, a portion of the air is diverted out of the stream and directed into the lower storage portion of the case. This air, which is refrigerated is directed along a path within the storage protion so as to in essence encircle the storage portion and is then fed back to the refrigerated air conduit so that it again can pass through the fan and the evaporator coils. In an alternative embodyment of the present invention, air can be diverted from the air conduit into the storage section from a location up-stream of the fan and/or evaporator coils.

The quantity of air passing between the refrigerated air conduit and the storage portion can be controlled by providing two overlapping slide plates which can be moved relative to each other so that the size of the overlapping openings can be varied thereby controlling the flow of air into the storage section. To help control the flow of air into the storage portion, a baffle can be inserted in the refrigerated air conduit for directing a portion of the air flow towards and through the opening between the conduit and the storage portion.

When the display case is operated within a refrigeration cycle of operation, the flow of refrigerated air through the storage section forms a protective curtain across an access opening that is provided within the storage portion, which opening is normally closed by a hinged door. Thus, when the hinged door is opened for enabling access to the refrigerated products within the storage portion the refrigerated air passing around the storage protion forms a protective barrier for preventing ambient air and moisture from outside the display case from entering the storage portion through such access opening. While reference is made herein to the use of a hinged door, other arrangements of the door can be provided.

The single band refrigerated display case such as described immediately above can be provided with an ambient air defrost system. For this purpose, the air circulating fans within the refrigerated air conduit are reversible fans which can be selectively controlled so as to reverse the direction of air flowing through the refrigerated air conduit. When the display case is switched into the defrost cycle of operation, the evaporation coils are turned off and the direction of air flow through the air conduit is reversed. During such reverse flow, air flows out of the air conduit through the air inlet. The air inlet is appropriately shaped so that when air is expelled therefrom, such air is directed up and away from the display case; thus, there is substantially no air curtain or continuous air band established that encircles the display portion during a defrost cycle of operation. Since the air is expelled and directed away from the display case, a partial vacuum is created within the air conduit thereby causing ambient air from outside of the display case to be sucked in through the air outlet of such conduit. The ambient air is then circulated through the conduit and the evaporation coils thereby defrosting the system. In addition, a portion of this ambient air is circulated in a reverse flow of air within the storage portion, a mechanism is provided for diverting a portion of the air flow through the refrigerated air conduit into the storage portion with this mechanism being located at the opposite end of the fan and refrigeration coils as the previously described mechanism for diverting the refrigerated air from the conduit into the storage portion. Now, when the door covering the access opening to the storage portion is opened instead of a protective air curtain being provided across such opening, the air that is circulated through the storage portion is flowing in such a direction that it passes out of the access opening and ambient air from outside the display case is drawn into the case through such access opening.

In an alternative embodiment of the present invention, a multiband refrigerated display case can be provided. While in the construction of such a multiband case, the same basic arrangement as the previously described single band case is provided, a second air conduit for carrying air which is unrefrigerated but still cooler than ambient air is incroprated in the display case. This second air conduit encircles both the display and storage portions of the case and includes a second air circulating fan for circulating air through the second conduit. Once again, a plurality of fans can be employed within this second conduit with the number of fans depending on the length of the case and the sizes of the fans. This second conduit has an outlet opening at one end and an inlet opening at its other end with such outlet and inlet openings being arranged at opposite ends of the opening in the top of the display case. This second conduit and its respective outlet and inlet openings are arranged outwardly of the first conduit and its openings so as to form a secondary air band which surrounds the refrigerated air band and likewise provides a protective air curtain outside of the refrigerated air curtain across the opening in the top of the display case.

In order to enable access into the storage portion of the multiband display case, the portion of the second air conduit in the area of the access opening to the storage portion can be separated into a plurality of vertical columns. Open spaces are provided between such columns which spaces correspond to the access openings within the display case for enabling access to the storage portion.

The multiband refrigerated display case also can employ an ambient air defrost system. For this purpose, the fan within the second air conduit is a reversible fan that can be selectively operated for reversing the direction of air flow through the second conduit during the defrost cycle of operation. Air passing through the second conduit then can be directed into the first air conduit and circulated through the first conduit. During a defrost operation, the refrigeration coils are turned off so that air that is fed through the first conduit is warmer than the refrigerated air and thereby serves to defrost the evaporation coils. In addition, any air which is not directed into the first air conduit from the second air conduit is expelled from the air inlet and directed away from the display case; thus, there is no continuous secondary air band formed. This action creates partial vacuum within the second air conduit which causes ambient air from outside of the display case to be drawn into the air outlet of the second air conduit. Such ambient air is circulated through the second conduit and directed into the first conduit for more efficiently defrosting the evaporation coils. During this operation, the direction of air flow through the first conduit can be maintained.

In an alternative embodiment, the direction of air flow through both air conduits is reversed with the air being expelled from both conduits through the air inlets and such air being directed away from the display case. With such an operation, ambient air from outside of the case then would be drawn into both air conduits with such ambient air serving to defrost the display case.

During the defrost cycle of operation, it is possible to increase the quantity of air flowing through the first air conduit. Such an increase in the flow of air would serve to more rapidly defrost the parts within the air conduit. This increase in air flow can be on the order of between 25 and 50%.

DESCRIPTION OF THE PREFERRED EMBODIMENTS

Figure 1:
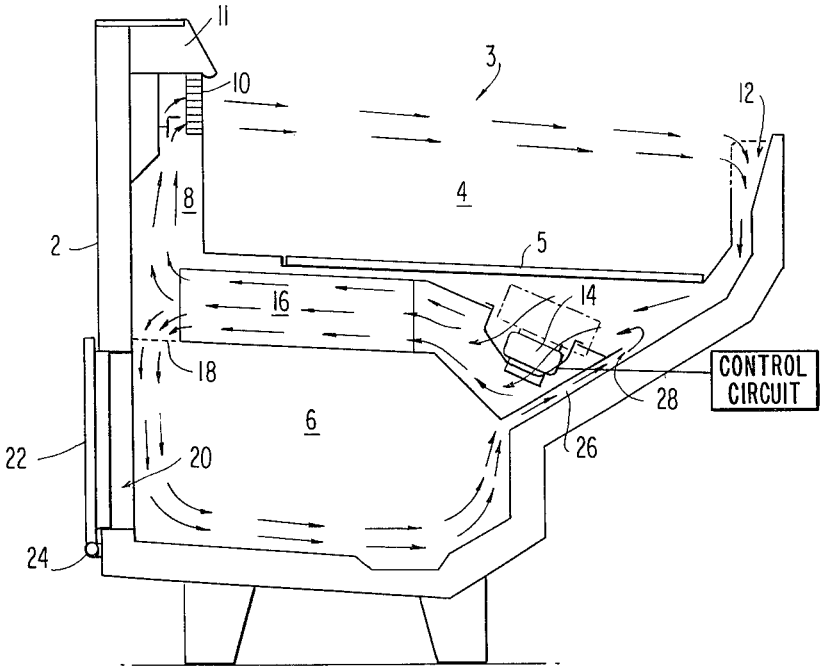
FIG. 1 is a side sectional elevational view of a single band refrigerated display case in accordance with the present invention during a refrigeration cycle of operation.

A single band refrigerated display case 2 having an upper display portion 4 and a lower storage portion 6 is illustrated in FIG. 1. Access to refrigerated products placed on shelf 5 in display portion 4 is obtained through an opening 3 in the top of display case 2. Surrounding three sides of display portion 4 of the case is a U-shaped air conduit 8 which comprises a first air conduit and serves to carry the refrigerated air for cooling the display case. Conduit 8 has an outlet opening 10 and an inlet opening 12 with such openings being arranged at opposite ends of opening 3 in display case 2. Openings 10 and 12 are aligned so that the air expelled from conduit 8 through outlet opening 10 is directed towards and received by opening 12 back into the conduit. In order to help direct air out of opening 10 and towards opening 12 a hood 11 is mounted at the top of conduit 8 above opening 10. Arranged within refrigerated air conduit 8 is at least one fan 14 for circulating air through the conduit and a set of evaporation coils represented by box 16 for refrigerating such air. The operation of the fan is controlled by a control circuit such as schematically shown in FIG. 1.

During a refrigeration cycle operation, fan 14 circulates air through refrigerated air conduit 8 in the direction of the arrows showing in FIG. 1. The air passes through and is refrigerated by evaporation coils 16 which are turned on during the refrigeration cycle. This refrigerated air is then expelled out of outlet opening 10 and propelled towards inlet opening 12 where it returns to conduit 8 for recirculation and refrigeration, thereby establishing a continuous band of refrigerated air. Thus, a curtain of refrigerated air is established across the opening 3 in the top of the display case as shown by the arrows in FIG. 1. Since some of the cold air from the refrigerated air curtain will descend into the case, the refrigerated air curtain helps to maintain the low temperature of the refrigerated products within display portion 4. This refrigerated air curtain also prevents ambient air from outside of the case from entering display portion 4.

A portion of the air that has passed through the refrigeration coils is diverted from conduit 8 through openings in a grid plate arranged in an opening 18 into storage portion 6 of display case 2. The grid plate with openings that are arranged in opening 18 acts to divert a portion of the air circulated through conduit 8 into storage portion 6. Due to the contour of storage portion 6, the air diverted from conduit 8 through opening 18 between conduit 8 and storage portion 6 is directed along a path so as to encircle the storage portion as shown by the arrows in FIG. 1. The air then passes back to conduit 8 on the opposite side of fan 14 through a connecting conduit 26 having an opening 28 that is in communication with conduit 8.

Storage portion 6 has an access opening 20 which is covered by a door 22 that is connected by a hinge 24 to display case 2. By opening door 22 access through opening 20 can be obtained to products stored within storage portion 6.

Figure 3:
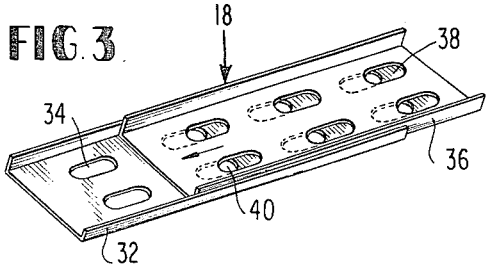
FIG. 3 is a perspective view of the plates arranged in the opening between the refrigerated air conduit and the storage portion for controlling the air flow from the refrigerated air conduit into the storage portion of the display case as illustrated in FIGS. 1 and 2.

Instead of a single grid plate within opening 18 between conduit 8 and storage portion 6 there can be arranged an air flow diverting means including two slotted plates 32 and 36. Plates 32 and 36 contain a plurality of slots 34 and 38 respectively. By varying the relative positions of plates 32 and 36, the size of overlapping opening portions 40 of the slots 34 and 38 can be varied. Since air only passes through openings 40, the flow of air between conduit 8 and storage portion 6 can be controlled by varying the size of openings 40. These plates are illustrated in FIG. 3.

Figure 2:
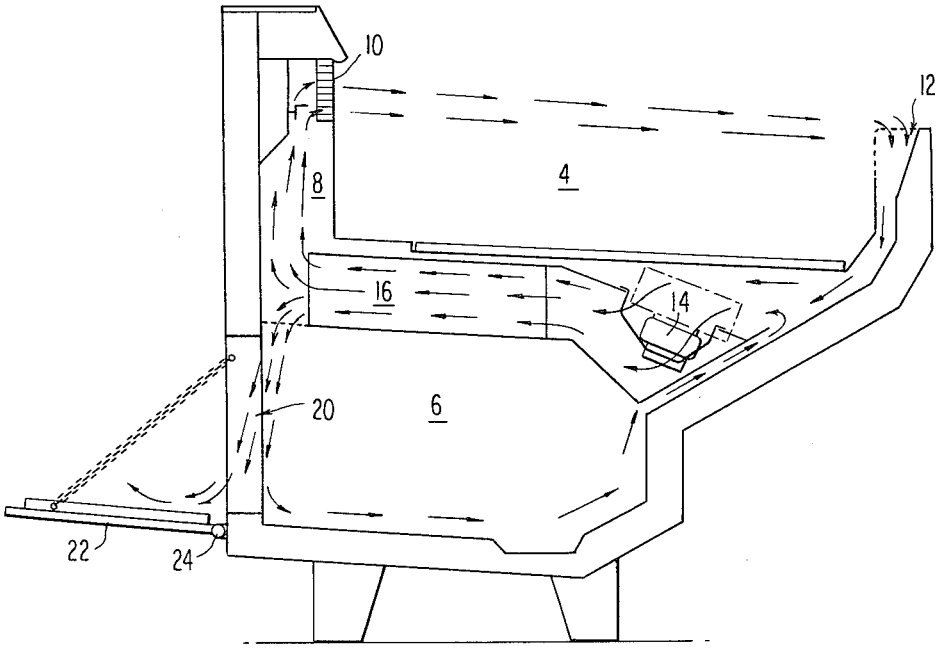
FIG. 2 is a view of the same case illustrated in FIG. 1 when the door to the storage portion of the case is opened.

During the refrigeration cycle of operation of display case 2, a protective air curtain is in effect formed across opening 20 for preventing ambient air and moisture from outside of the display case from entering storage portion 6 when door 22 is opened. Thus, as shown by the arrows in FIG. 2 representing the air flow patterns when door 22 is opened, a portion of the refrigerated air circulated within storage portion 6 passes out through opening 20 and in effect blocks the entrance of ambient air into the storage portion. In this manner, any disruption to the cooling operation of the system is prevented.

During a defrost cycle of operation of display case 2, the direction of flow of the air through conduit 8 is reversed. In addition, during the defrost cycle evaporation coils 16 are turned off so that the air passing through conduit 8 is not refrigerated.

Figure 4:
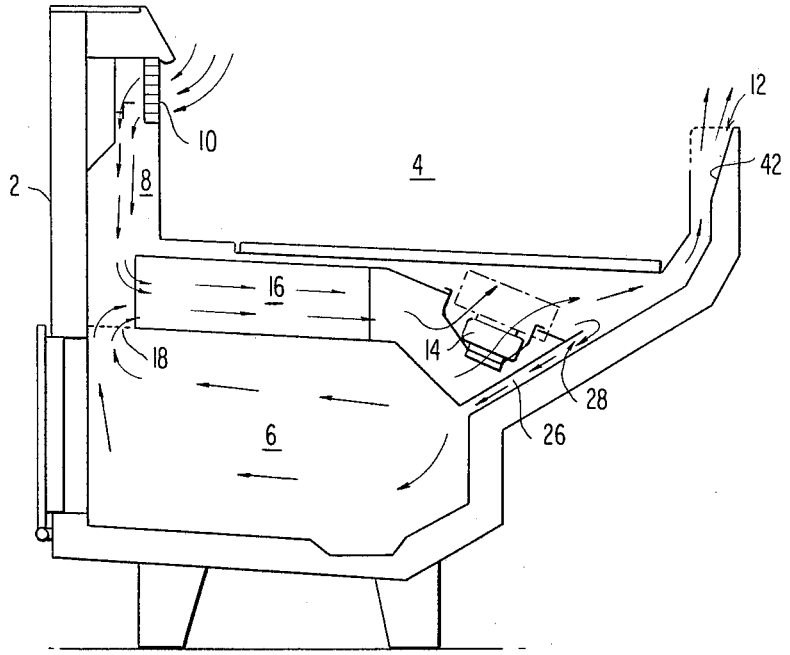
FIG. 4 is a view similar to FIG. 1 during a defrost cycle of operation of the display case.

Since air is flowing in a reverse direction through conduit 8 during a defrost cycle, the air is expelled by inlet opening 12. Opening 12 has a sloped outer surface 42 which causes the air expelled through opening 12 to be directed upwardly and away from display portion 4 of the display case, thereby eliminating the existence of a continuous band of air circulating around display portion 4. This operation causes an effective partial vacuum to be formed in conduit 8 in the area of opening 10. This partial vacuum serves to cause ambient air from outside of the case to be drawn into conduit 8. This ambient air is then circulated through conduit 8 and expelled through opening 12. The direction of air flow during the defrost cycle of operation of display case 2 is shown by the arrows in FIG. 4.

Figure 5:
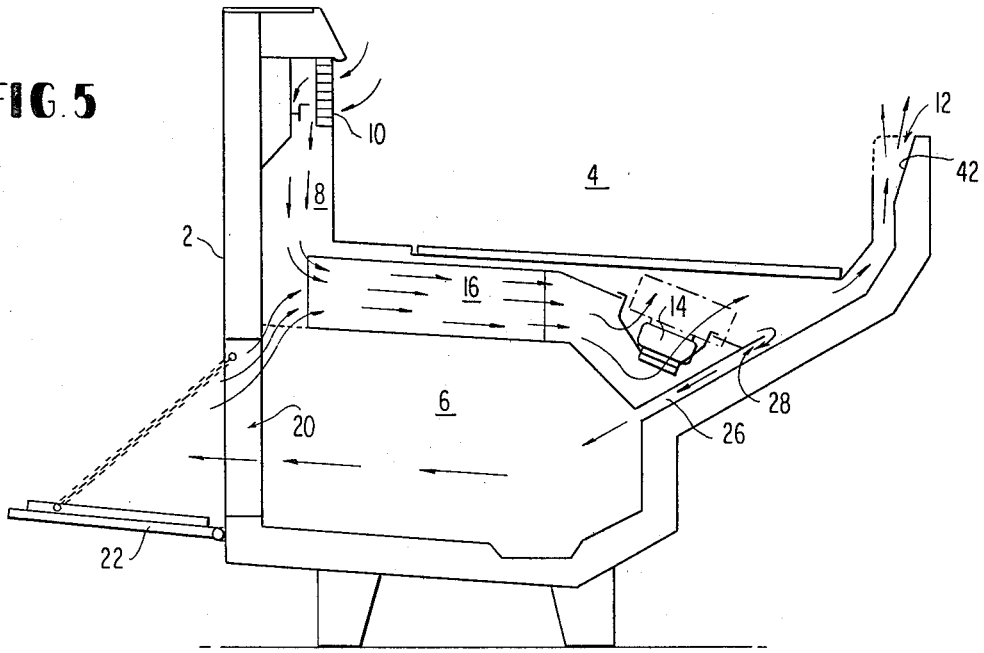
FIG. 5 is a view similar to FIG. 2 of the display case with the case being operated in a defrost cycle of operation.

During the defrost cycle of operation of display case 2, the direction of air flow through storage portion 6 also is reversed. Since air flows in the opposite direction through conduit 8, the air propelled by fan 14 can be directed into opening 28 and down through conduit 26 into storage portion 6; an appropriate baffle or scoop can be arranged between conduits 8 and 26 for directing air through opening 28 into conduit 26. This air then returns to conduit 8 through opening 18. During the defrost cycle of operation, if door 22 is opened for enabling access to storage portion 6, the air flowing through the storage portion passes out along the bottom of the storage portion and out through access opening 20. Simultaneously ambient air from outside of the case is drawn into the storage portion. This ambient air enters the flow path of the air through the storage portion so as to pass through opening 18 and into the air flow through conduit 8. The flow patterns of air through the storage portion during the defrost cycle of operation are shown by the arrows in FIGS. 4 and 5.

In an alternative embodiment of the present invention, a multiband refrigerated display case such as illustrated in FIGS. 6 through 9 can be provided. In essence, this arrangement is similar to the single band case discussed above with respect to FIGS. 1 through 5 except that a second air band of unrefrigerated but cool air encircles both the display portion 4 and storage portion 6.

Multiband case 44 has an upper display portion 4 and a lower storage portion 6. Access to refrigerated products within display portion 4 is obtained through opening 3 in the top of the case. Surrounding display portion 4 is first air conduit 8 having an air outlet opening 10 and an air inlet opening 12. By circulating air through conduit 8, a continuous air band is established such as shown by the arrows in FIG. 6. The air is circulated through conduit 8 by a fan 46 and as it is circulated it is refrigerated by evaporation coils 16. As with single band case 2, a portion of the refrigerated air passing through evaporation coils 16 is diverted into and directed around storage portion 6 for cooling the products stored within that section. The air passing through storage portion 6 is then returned to conduit 8 upstream of fan 46 via connecting conduit 26.

Encircling both display portions 4 and storage portion 6 is a second air conduit comprising U-shaped conduit 48 which carries a band of unrefrigerated but cooler than ambient air. Conduit 48 has an air outlet opening 50 at one of its upper ends and an air inlet opening 52 at the opposite end. Openings 50 and 52 are arranged on opposite sides of opening 3 at the top of display case 44 and furthermore are in alignment so that air expelled through outlet opening 50 is directed towards and received by inlet opening 52. The air is circulated through conduit 48 by a fan 54 thereby establishing a continuous air band during the refrigeration cycle such as shown by the arrows in FIG. 6. Since conduit 48 is adjacent and in fact shares a common wall with a substantial portion of conduit 8 and refrigerated storage portion 6, by conduction the air passing through conduit 48 is cooled so as to be of a temperature lower than ambient air although the air is not refrigerated.

Figure 6:
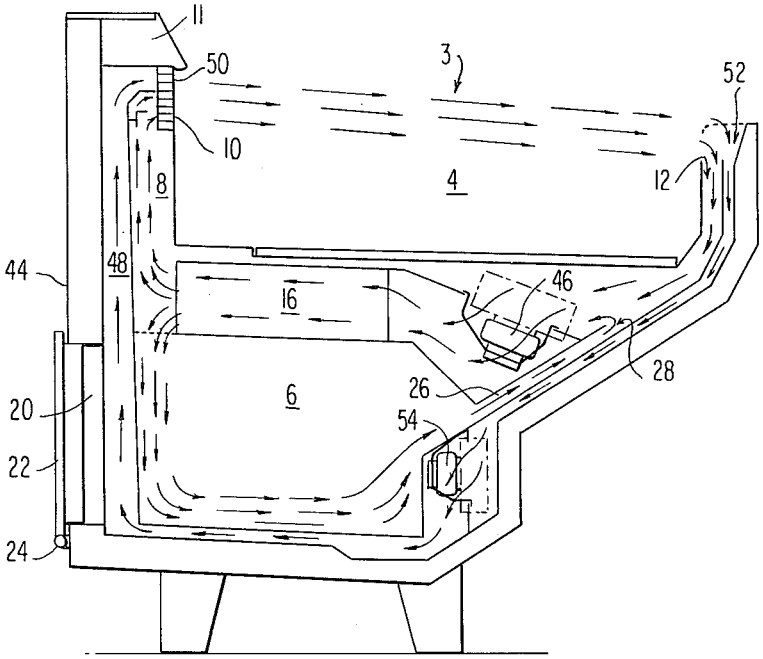
FIG. 6 is a side elevational sectional view of a multiband refrigerated display case in accordance with the present invention during a refrigeration cycle of operation.

As can be seen from FIG. 6, conduit 48 passes along the area of access opening 20 which provides access to storage portion 6. In order to enable access through this opening, it is possible to separate at least a portion of the vertical section of conduit 48 adjacent access opening 20 into a plurality of separate vertically extending conduits which are spaced by a sufficient distance to enable access through opening 20. These spaced sections of conduit 48 are then re-joined at the upper portion of display case 44 into a single conduit prior to air being expelled through outlet opening 50.

The outer air curtain that is formed across opening 3 in the top of display case 44 by the circulation of air through air conduit 48 constitutes a protective barrier preventing ambient air and moisture from entering display portion 4. The outer air curtain also prevents such ambient air from being mixed with the refrigerated air band which is inside of the protective air curtain.

Figure 7:
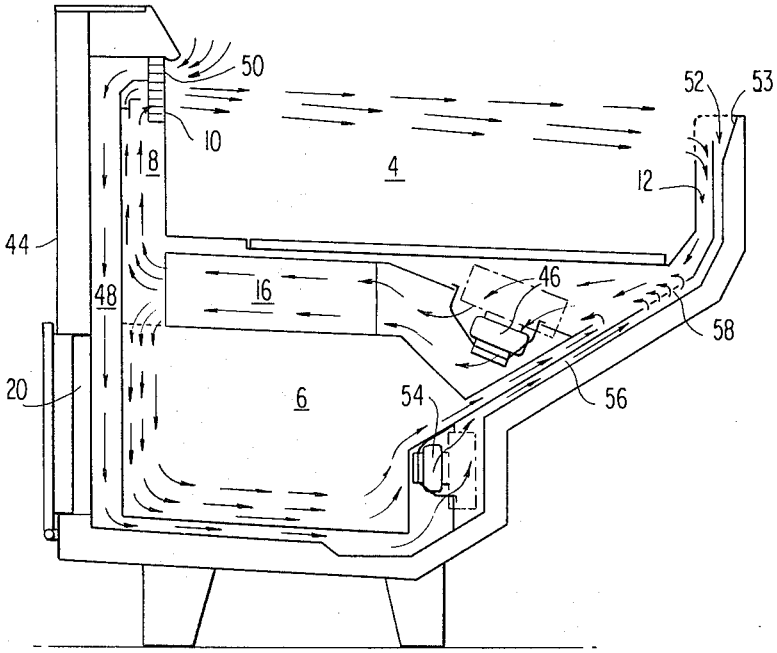
FIG. 7 is a side elevational sectional view of another embodiment of a multiband refrigerated display case during a defrost cycle of operation.
Figure 8:
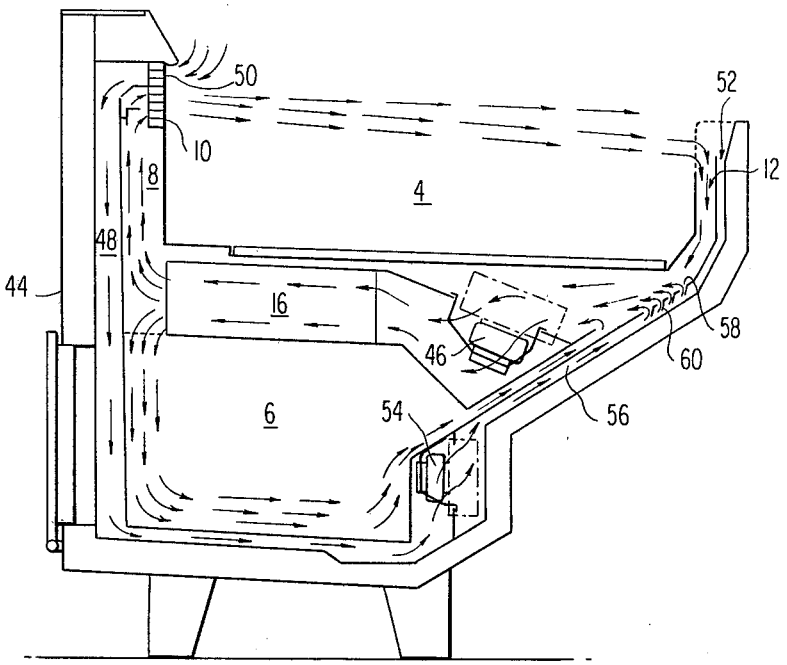
FIG. 8 is a side elevational sectional view of a still further embodiment of a multiband refrigerated display case of the present invention during a defrost cycle of operation.
Figure 9:
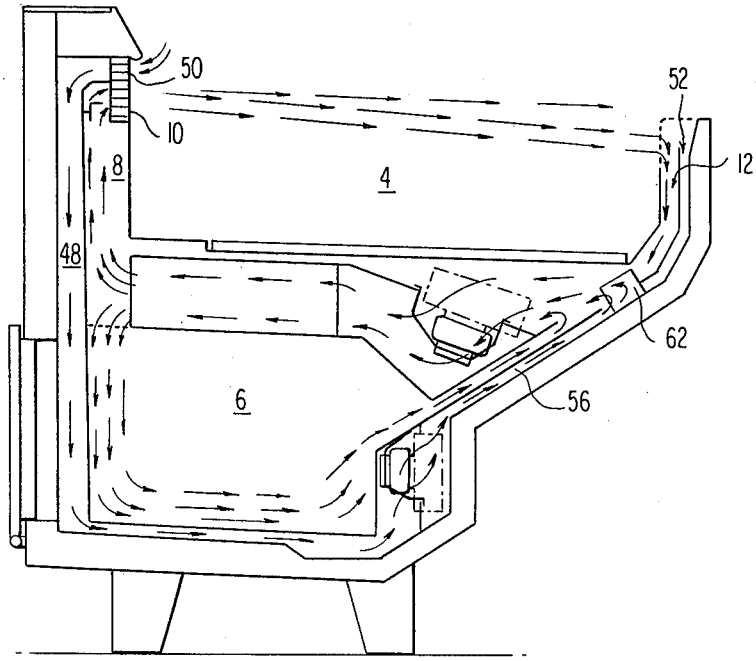
FIG. 9 is a side elevational sectional view of a still further multiband refrigerated display case in accordance with the present invention during a defrost cycle of operation.

During a defrost cycle of operation of multiband display case 44, the direction of air flow through air conduit 48 is reversed such as shown by the arrows in FIGS. 7, 8 and 9. During such a defrost cycle of operation, however, the direction of air flow through conduit 8 can remain unchanged although operation of evaporation coils 16 will be turned off.

The direction of air flow through conduit 48 is changed by reversing the direction of operation of fan 54. Thus, during the defrost cycle of operation, any air leaving the conduit will be expelled through opening 52 which has a sloped outer side portion 53 so as to direct such air up and away from display case 44. More importantly, however, air passing along conduit 48 will be directed into conduit 8 through a plurality of openings 58 located within portion 56 of conduit 48. The majority of the air flow along portion 56 will be directed into conduit 8 and through fan 46 so as to be circulated in the air band established within conduit 8 and across opening 3 in the top of display case 44. Since the air band associated with conduit 48 has been eliminated during the defrost cycle of operation, a partial vacuum is created within conduit 48 in the area of opening 50, which will cause ambient air from outside of the display case to be drawn into conduit 48 for circulation through the conduit. Such ambient air is directed through openings or perforations 58 in the common wall between the conduits into conduit 8 for defrosting the elements within that conduit.

To assist in the diversion of air from conduit 48 into conduit 8 a plurality of guide fins 60 can be provided along openings 58 such as shown in FIG. 8. Alternatively, a plurality of air scoops 62, which are merely curved plates, can be positioned within the openings between portion 56 of conduit 48 and conduit 8 for directing a portion of the air there passing along conduit 48 into conduit 8 such as shown in FIG. 9.

The present invention may be embodied in other specific forms without departing from the spirit or essential characteristics thereof. The present embodiments are presented merely as illustrative and not restrictive with the scope of the invention being indicated by the attached claims rather than foregoing description. All changes which come within the meaning and range of equivalency of the claims are therefore intended to be embraced therein.

What is claimed is:

1. An open top refrigerated display case comprising:

an upper display portion for displaying products to be refrigerated;

a lower storage portion for storing products to be refrigerated;

cooling means for cooling both said display portion and said storage portion of said display case, said cooling means including means for establishing a first band of air encircling said display portion, said means for establishing said first air band including a first air conduit passing around said display portion of said display case, said first air conduit having a first air outlet through which air can be expelled from said first air conduit and a first air inlet through which air can enter said first air conduit with said first air outlet and said first air inlet being located at opposite ends of said display case so as to direct air across the opening in the top of said display case and in alignment so that air leaving said first air outlet is directed towards and received by said first air inlet, first air circulating means for circulating air along said first air conduit during a refrigeration cycle such that air is expelled from said first air outlet and received by said first air inlet thereby establishing a first air curtain along the opening in the top of said display case, and refrigeration means arranged within said first air conduit for refrigerating the air of the first air band passing along said first air conduit during the refrigeration cycle of operation of said display case so as to form a refrigerated air band; and, first means for diverting a portion of the air of the refrigerated air band out of said first air conduit and enabling such diverted refrigerated air to pass from said first air conduit into said storage portion for cooling said storage portion, said first diverting means being located within said first air conduit at a location downstream of said first air circulating means and said refrigeration means.

2. A display case according to claim 1 wherein said first air conduit is located above said storage portion so as to pass between said storage portion and said display portion of said display case.

3. A display case according to claim 2 further comprising an access opening within an outer wall of said storage portion and a hinged door covering said opening within said storage portion for enabling access to said storage portion.

4. A display case according to claim 3 further comprising means for guiding the refrigerated air diverted into said storage portion along a path so that such air enters at one side of said storage portion and returns from the other side of said storage portion to said first air conduit at a location upstream of said first air circulating means so that a protective air curtain is formed across said opening within said storage portion when said door is opened thereby preventing ambient air from outside of said display case from entering said storage portion.

5. A display case according to claim 4 wherein said first air circulating means includes at least one reversible fan for propelling air along said first air conduit in a first direction for establishing said refrigerated air band during a refrigeration cycle and propelling air in a reverse direction during a defrost cycle; and, further comprising means for selectively switching said display case between a refrigeration cycle and a defrost cycle and accordingly controlling the operation of said reversible fan and turning off said means for refrigerating air within said air conduit during a defrost cycle so that air warmer than the refrigerated air is circulated through said first air conduit during a defrost cycle and second means for diverting air from said first air conduit into said storage portion during such reverse air flow so that during a defrost cycle of operation air also flows through said storage portion in a reverse direction and when said door to said storage portion is opened ambient air from outside of said display case enters through said access opening in said storage portion and such ambient air is drawn into said first air conduit.

6. A display case according to claim 1, 2 or 4 wherein said first air circulating means includes at least one reversible fan for propelling air along said first air conduit in a first direction for establishing said refrigerated air band during a refrigeration cycle and propelling air in a reverse direction during a defrost cycle; and, further comprising means for selectively switching said display case between a refrigeration cycle and a defrost cycle and accordingly controlling the operation of said reversible fan and turning off said means for refrigerating air within said air conduit during a defrost cycle so that air warmer than the refrigerated air is circulated through said first air conduit during a defrost cycle.

7. A display case according to claim 6 wherein during a defrost cycle air is expelled from said first air inlet and said first air inlet directs such air away from said display case and ambient air from outside of said display case is drawn into said first air outlet for circulation through said first air conduit.

8. A display case according to claim 7 wherein said first diverting means for diverting air from said first air conduit into said storage portion includes a plate separating said first air conduit and said storage portion, said plate having a plurality of slots therein for enabling air to pass between said first air conduit and said storage portion and said first diverting means further including means for varying the sizes of said slots within said plate so as to enable the flow of air between said first air conduit and said storage portion to be controlled.

9. A display case according to claim 7 further comprising second means for diverting air from said first air conduit into said storage portion of said display case during a defrost cycle of operation for establishing a reverse direction of air flow through said storage portion.

10. A display case according to claim 1, 2 or 4 further comprising a second air conduit within said display case positioned outwardly of said first air conduit, said second air conduit being arranged so that air circulated therethrough can be partially cooled by conduction by the refrigerated air circulated through said first air conduit.

11. A display case according to claim 10 wherein said second air conduit encircles both said display portion and said storage portion of said display case and said second air conduit has a second air outlet opening at one end of the opening in the top of said display case and a second air inlet at the opposite end of the opening in the top of said display case; and, further comprising second air circulating means for circulating air along said second air conduit so that air is expelled from said second air outlet of said second air conduit and received by said second air inlet thereby establishing a second air curtain along the opening in the top of said display case with said second air curtain being located outwardly of said first air curtain.

12. A display case according to claim 11 further comprising means for selectively switching said display case between a refrigeration cycle of operation and a defrost cycle of operation so that during a defrost cycle of operation said second air circulating means circulates air through said second air conduit in a direction reverse of the air flow during a refrigeration cycle.

13. A display case according to claim 12 wherein said second air circulating means includes at least one reversible fan for reversing the direction of the air flow through said second air conduit during a defrost cycle of operation so that a portion of the air passing along said second air conduit is expelled from said second air inlet with said second air inlet directing such air away from said display case and ambient air from outside of said display case is drawn into said second air outlet of said second air conduit and said switching means turns off said refrigeration means during a defrost cycle so that air passing through said first air conduit is not refrigerated; and, further comprising directing means for directing a portion of the air passing along said second air conduit during a reverse flow of air from said second air conduit into said first air conduit.

14. A display case according to claim 13 wherein said first and second air conduits have at least a partial common wall and said directing means includes a plurality of air scoops, each being located within a corresponding opening provided in said common wall between said second air conduit and said first air conduit.

15. A display case according to claim 13 wherein said first and second air conduits have at least a partial common wall, a plurality of perforations are provided in said common wall between said first air conduit and said second air conduit.

16. A display case according to claim 15 wherein a plurality of fins are provided, each being adjacent one of said perforations in said common wall for directing air from said second air conduit into said first air conduit during a reverse flow of air during a defrost cycle of operation.

17. A display case according to claim 13 wherein during a defrost cycle of operation the quantity of air flowing through said first air conduit is maintained at approximately the same level as the flow of air during a refrigeration cycle of operation.

18. A display case according to claim 13 wherein during a defrost cycle of operation the quantity of air flowing through said first air conduit is increased to a level higher than the quantity of air flowing through said first air conduit during a refrigeration cycle of operation.

19. An open top refrigerated display case comprising:

a display portion for displaying products to be refrigerated;

a storage portion for storing products to be refrigerated;

cooling means for cooling both said display portion and said storage portion of said display case, said cooling means including means for establishing a first band of air encircling said display portion, said means for establishing said first air band including a first air conduit passing around said display portion of said display case, said first air conduit having a first air outlet through which air can be expelled from said first air conduit and a first air inlet through which air can enter said first air conduit with said first air outlet and said first air inlet being located at opposite ends of said display case so as to direct air across the opening in the top of said display case and in alignment so that air leaving said first air outlet is directed towards and received by said first air inlet, first air circulating means for circulating air along said first air conduit during a refrigeration cycle such that air is expelled from said first air outlet and received by said first air inlet thereby establishing a first air curtain along the opening in the top of said display case, and refrigeration means arranged within said first air conduit for refrigerating the air of the first air band passing along said first air conduit during a refrigeration cycle of operation of said display case so as to form a refrigerated air band;

first means for diverting a portion of the air of the refrigerated air band out of said first air conduit and enabling such diverted refrigerated air to pass from said first air conduit into said storage portion for cooling said storage portion, said first diverting means being located within said first air conduit at a location downstream of said first air circulating means and said refrigeration means;

means for establishing a second air band around said display portion and said storage portion of said display case, said means for establishing said second air band including a second air conduit within said display case positioned outwardly of said first air conduit and encircling both said display portion and said storage portion, said second air conduit having a second air outlet opening at one end of the opening in the top of said display case and a second air inlet at the opposite end of the opening in the top of said display case, second air circulating means for circulating air along said second air conduit so that air is expelled from said second air outlet and received by said second air inlet threby establishing a second air curtain across the opening in the top of said display case with said second air curtain being located outwardly of said first air curtain; and, control means for selectively switching said display case between a refrigeration cycle and a defrost cycle and controlling said first and second air circulating means and said refrigeration means so that during a refrigeration cycle air is circulated along said first and second air conduits so as to form the respective said air bands with the air in said first air conduit being refrigerated by said refrigeration means, and during a defrost cycle said refrigeration means is turned off, the flow direction of air through one of said first and second conduits is reversed so that ambient air is drawn into such air conduit and at least a portion of such ambient air is fed through said first air conduit.

20. A display case according to claim 19 wherein during a defrost operation said control means cause said second air circulating means to circulate air through said second air conduit in a reverse direction of the air flow during a refrigeration cycle.

21. A display case according to claim 20 wherein said second air circulating means includes at least one reversible fan for reversing the direction of the air flow through said second air conduit during a defrost cycle of operation so that ambient air from outside of said display case is drawn into said second air outlet of said second air conduit and any air passing completely through said second air conduit is expelled from said second air inlet with said second air inlet directing such air away from said display case; and, further comprising directing means for directing a portion of the air passing along said second air conduit during a reverse flow of air from said second air conduit into said first air conduit.

22. A display case according to claim 21 wherein said directing means includes a plurality of air scoops located within at least one opening provided between said second air conduit and said first air conduit.

23. A display case according to claim 21 wherein said first and second air conduits have at least a partial common wall, a plurality of perforations are provided in said common wall between said first air conduit and said second air conduit for enabling air to pass between said conduits.

24. A display case according to claim 23 wherein a plurality of fins are provided adjacent said perforations in said common wall for directing air from said second air conduit into said first air conduit during a reverse flow of air during a defrost cycle of operation.

25. A display case according to claim 21 wherein during a defrost cycle of operation the quantity of air flowing through said first air conduit is maintained at the same level as the flow of air during a refrigeration cycle of operation.

26. A display case according to claim 21 wherein during a defrost cycle of operation the quantity of air flowing through said first air conduit is increased to a level higher than the quantity of air flowing through said first air conduit during a refrigeration cycle of operation.

27. A display case according to claim 21 wherein said first air conduit is located above said storage portion so as to pass between said storage portion and said display portion of said display case.

28. A display case according to claim 27 further comprising an access opening within an outer wall of said storage portion and a hinge door covering said opening within said storage portion for enabling access to said storage portion.

29. A display case according to claim 28 further comprising means for guiding the refrigerated air diverted into said storage portion along a path so that such air enters at one side of said storage portion and returns from the other side of said storage portion to said first air conduit at a location upstream of said first air circulating means so that a protective air curtain is formed across said opening within said storage portion when said door is opened thereby preventing ambient air from outside of said display case from entering said storage portion.

30. A display case according to claim 29 wherein during a defrost cycle of operation the quantity of air flowing through said first air conduit is maintained at the same level as the flow of air during a refrigeration cycle of operation.

31. A display case according to claim 29 wherein during a defrost cycle of operation the quantity of air flowing through said first air conduit is increased to a level higher than the quantity of air flowing through said first air conduit during a refrigeration cycle of operation.

32. A display case according to claim 19, 26 or 31 wherein the air flow through said first air conduit during a defrost cycle is increased by 25 to 50%.

33. A refrigerated display case comprising:

an upper display portion for displaying products to be refrigerated and having an opening therein for enabling access to such products;

a lower storage portion for storing products to be refrigerated;

cooling means for cooling both said display portion and said storage portion of said display case, said cooling means including means for establishing a first band of air encircling said display portion, said means for establishing said first air band including a first air conduit passing around said display portion of said display case, said first air conduit having a first air outlet through which air can be expelled from said first air conduit and a first air inlet through which air can enter said first air conduit with said first air outlet and said first air inlet being located at opposite ends of said display case so as to direct air across the opening in said display case and in alignment so that air leaving said first air outlet is directed towards and received by said first air inlet, first air circulating means for circulating air along said first air conduit during a refrigeration cycle such that air is expelled from said first air outlet and received by said first air inlet thereby establishing a first air curtain along the opening in the top of said display case, and refrigeration means arranged within said first air conduit for refrigerating the air of the first air band passing along said first air conduit during the refrigeration cycle of operation of said display case so as to form a refrigerated air band; and, first means for diverting a portion of the air of the refrigerated air band out of said first air conduit and enabling such diverted refrigerated air to pass from said first air conduit into said storage portion for cooling said storage portion, said first diverting means being located within said first air conduit at a location downstream of said first air circulating means and said refrigeration means.

34. A display case according to claim 33 wherein said first air conduit is located above said storage portion so as to pass between said storage portion and said display portion of said display case.

35. A display case according to claim 34 further comprising an access opening within an outer wall of said storage portion and a hinged door covering said opening within said storage portion for enabling access to said storage portion.

36. A display case according to claim 35 further comprising means for guiding the refrigerated air diverted into said storage portion along a path so that such air enters at one side of said storage portion and returns from the other side of said storage portion to said first air conduit at a location upstream of said first air circulating means so that a protective air curtain is formed across said opening within said storage portion when said door is opened thereby preventing ambient air from outside of said display case from entering said storage portion.

37. An open top refrigerated display case comprising:

an upper display portion for displaying products;

a lower storage portion for storing products;

cooling means for cooling both said display portion and said storage portion of said display case, said cooling means including means for establishing a first band of air encircling said display portion, said means for establishing said first air band including a first air conduit passing around said display portion of said display case, said first air conduit having a first air outlet through which air can be expelled from said first air conduit and a first air inlet through which air can enter said first air conduit with said first air outlet and said first air inlet being located at opposite ends of said display case so as to direct air across the opening in the top of said display case and in alignment so that air leaving said first air outlet is directed towards and received by said first air inlet, first air circulating means for circulating air along said first air conduit during a refrigeration cycle such that air is expelled from said first air outlet and received by said first air inlet thereby establishing a first air curtain along the opening in the top of said display case, and refrigeration means for refrigerating air of the first air band passing along said first air conduit during the refrigeration cycle of operation of said display case so as to form a refrigerated air band; and, first means for diverting a portion of the air of the refrigerated air band from said first air conduit and enabling such diverted refrigerated air to pass from said first air conduit into said storage portion for cooling said storage portion, said first diverting means being located in said first air conduit.

38. An open top refrigerated display case comprising:

a display portion for displaying products;

a storage portion for storing products;

cooling means for cooling both said display portion and said storage portion of said display case, said cooling means including means for establishing a first band of air encircling said display portion, said means for establishing said first air band including a first air conduit passing around said display portion of said display case, said first air conduit having a first air outlet through which air can be expelled from said first air conduit and a first air inlet through which air can enter said first air conduit with said first air outlet and said first air inlet being located at opposite ends of said display case so as to direct air across the opening in the top of said display case and in alignment so that air leaving said first air outlet is directed towards and received by said first air inlet, first air circulating means for circulating air along said first air conduit during a refrigeration cycle such that air is expelled from said first air outlet and received by said first air inlet thereby establishing a first air curtain along the opening in the top of said display case, and refrigeration means for refrigerating air of the first air band passing along said first air conduit during a refrigeration cycle of operation of said display case so as to form a refrigerated air band;

first means for diverting a portion of the air of the refrigerated air band from said first air conduit and enabling such air to pass from said first air conduit into said storage portion for cooling said storage portion, said first diverting means being located in said first air conduit;

means for establishing a second air band around said display portion and said storage portion of said display case, said means for establishing said second air band including a second air conduit within said display case positioned outwardly of said first air conduit and encircling both said display portion and said storage portion, and said second air conduit having a second air outlet opening at one end of the opening in the top of said display case and a second air inlet at the opposite end of the opening in the top of said display case, second air circulating means for circulating air along said second air conduit so that air is expelled from said second air outlet and received by said second air inlet thereby establishing a second air curtain across the opening in the top of said display case with said second air curtain being located outwardly of said first air curtain; and, control means for selectively switching said display case between a refrigeration cycle and a defrost cycle and controlling said first and second air circulating means and said refrigeration means so that during a refrigeration cycle air is circulating along said first and second air conduits so as to form the respective said air bands with the air in said first air conduit being refrigerated by said refrigeration means, and during a defrost cycle said refrigeration means is turned off, the flow direction of air through one of said first and second conduits is reversed so that ambient air is drawn into such air conduit and at least a portion of such ambient air is fed through said first air conduit.

* * * * *